US005415313A

United States Patent [19]

Sang-Seo

[11] Patent Number: 5,415,313

[45] Date of Patent: May 16, 1995

[54] CAN

[76] Inventor: Hong Sang-Seo, Joogong Apartment 1027-1117, Sangge 8 Dong, Nowon-Ku, Seoul, Rep. of Korea

[21] Appl. No.: 195,550

[22] Filed: Feb. 14, 1994

[51] Int. Cl.[6] ..... B65D 17/32

[52] U.S. Cl. ..... 220/269; 220/270; 220/717; 222/531; 222/541

[58] Field of Search ..... 220/269, 270, 271, 272, 220/273, 716, 717; 222/529, 531, 538, 541, 566, 574

[56] References Cited

U.S. PATENT DOCUMENTS

| | | | |
|---|---|---|---|
| 3,473,705 | 10/1969 | May et al. | 222/541 |
| 3,481,515 | 12/1969 | Booth et al. | 222/541 X |
| 4,000,838 | 1/1977 | Bogert | 222/529 |
| 4,407,425 | 10/1983 | Combs | 220/269 |

FOREIGN PATENT DOCUMENTS

| | | |
|---|---|---|
| 84-761 | 6/1984 | Rep. of Korea . |
| 86-3506 | 12/1986 | Rep. of Korea . |
| 91-1621 | 3/1991 | Rep. of Korea . |

*Primary Examiner*—Allan N. Shoap
*Assistant Examiner*—Nova Stucker
*Attorney, Agent, or Firm*—Nawrocki, Rooney & Sivertson

[57] ABSTRACT

A can for containing beverages. The can includes a sanitary beverage guider normally hidden under a can lid and jumping out of the cart lid when opening the can lid by pulling a handle ring along with an opening part of the can lid. The guider guides the beverages when drinking the beverages, thus to prevent the contaminants of the can lid from introduction into the human body and to achieve a desired good sanitary condition. The cutting line along which the opening part is cut off may remain a connection part at inside ends thereof, thus to still partially connect the opening part to the can lid when the can is opened by drawing the opening part. Hence, this can is thrown away under the condition that the opening part is not completely removed from the can body, thus to prevent the opening part from causing an environmental contamination and a wound.

7 Claims, 9 Drawing Sheets

CAN

BACKGROUND OF THE INVENTION

1. Field of the Invention

The present invention relates in general to a can for containing liquid materials such as alcoholic beverages and cooling beverages therein and, more particularly, to a can having an opening part provided on a can lid by forming a weakened cutting line, the opening part being drawn in order for opening the can lid 2. Description of the Prior Art Conventionally, varieties of cans for containing liquid foods such as alcoholic beverages and cooling beverages are produced using a thin steel plate or an aluminum alloy plate. In order to produce canned beverages, the body of a can filled with the beverages is lidded such as by seaming and sealed up.

At this time, the lid of the can is previously provided with an opening part which will be pulled apart from the lid for provision of opening when drinking the canned beverages. The opening part of the lid is defined by a weakened cutting line and rivetted to a handle ring at an end section thereof. Hence, in order to pull the opening part and open the can lid for drinking the canned beverages, the handle ring is pulled in order to cut the opening part off along the weakened cutting line and to provide the opening through which the beverages are discharged from the can.

However, the above can for beverages always exposes its lid including the opening part to the environment during transportation and exhibition, so that the lid of the can is apt to be contaminated by contaminants such as dirt. In this regard, the above can has a hygienic problem in that part of the contaminants of the lid is introduced into the human body along with the canned beverages when drinking the beverages while contacting the lips to about the opening of the can lid. In order to prevent introduction of contaminants into the human body when drinking the beverages, the can lid about the opening part should be cleaned such as by a paper before separation of the opening part or before drinking of the canned beverages.

In an effort to overcome the above hygienic problem of the can, there have been proposed cans including their respective straws such as disclosed in Korean Utility Model Publication Nos. 84-761, 86-3506 and 91-1621. When drinking the beverages of the above cans provided with their respective straws, the straws are used.

However, the cans provided with their respective straws disclosed in the above Korean Utility Models, while overcoming the hygienic problem by using the straws when drinking the beverages, nevertheless have a problem that their constructions are relatively complex and, in this regard, not suitable for mass production. Another problem of the cans with the straws is resided in that provision of the straws for the cans increase the manufacturing cost of the cans. Due to the increased manufacturing cost, the cans with the straws are not practically used. Furthermore, the cans with the straws can not be used for alcoholic beverages which are not customarily drunk through the straws.

On the other hand, the opening parts of the cans cause an environmental contamination as well as a wound. That is, the sharp opening parts are completely cut off from their respective can bodies and thrown away separately from the can bodies. In this regard, the opening parts generally cause the environmental contamination and the wound. Particularly when the sharp opening parts are thrown away on a beach, they may cause the people on the beach to be wounded in their bare feet. The sharp opening parts also cause wounds of child regardless of their throwing places.

SUMMARY OF THE INVENTION

It is, therefore, an object of the present invention to provide a can in which the aforementioned problems can be overcome and which includes a novel sanitary beverage guider normally provided under a can lid and jumping out of the can lid when opening the can lid by pulling a handle ring along with an opening part of the can lid and guiding the beverages when drinking the beverages, thus to prevent the contaminants of the can lid from introduction into the human body and to achieve a desired good sanitary condition, and which is thrown away under the condition that the opening part is not completely separated from the can body, thus to prevent the opening part from causing an environmental contamination and a wound.

It is another object of the present invention to provide a can which has such simple construction that it is suitable for mass production and reduces the manufacturing cost and of which the beverage guider is normally hidden in the can body, thus to be prevented from contamination by outside contaminants and to achieve a good sanitary condition and which is generally used for containing varieties of beverages regardless of their kinds.

In an embodiment, the present invention provides a can including a can body sealed up by a can lid having an opening part for opening the can, further comprising a flexible beverage guider mounted on a mounting part provided on a lower surface of the can lid at a position adjacent to an outside edge of the opening part, the guider being normally hidden under the can lid but exposed to the outside of the can lid when the opening part is drawn in order to open the can.

In another embodiment, the present invention provides a can including a can body sealed up by a can lid having an opening part for opening the can, wherein the opening part is defined by a cutting line at which the opening part is partially cut off from the can lid and provides an opening through which canned beverage is discharged from the can, the cutting line remaining a connection part at inside ends thereof, thus to still partially connect the opening part to the can lid when the can is opened by drawing the opening part.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
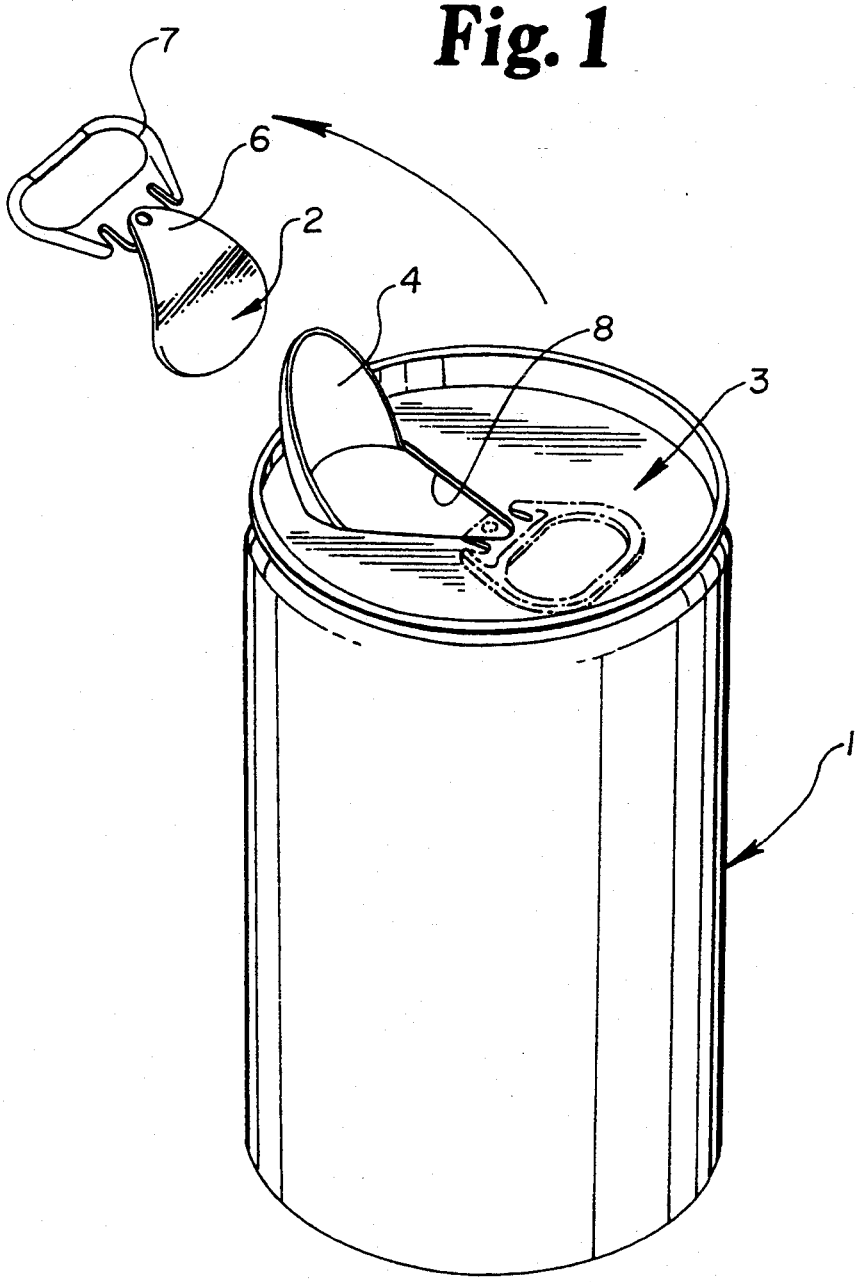
FIG. 1 is a perspective view of a can in accordance with a primary embodiment of the present invention, showing an opening operation of the can.
Figure 2:
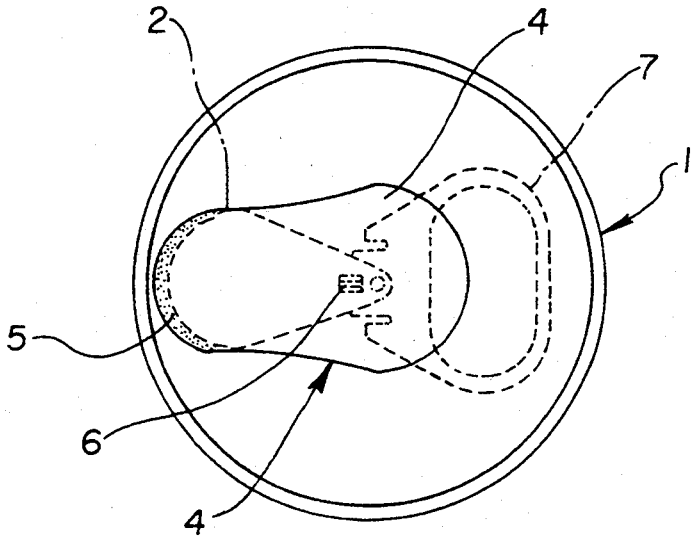
FIG. 2 is a cross sectional view of the can of FIG. 1.
Figure 3:
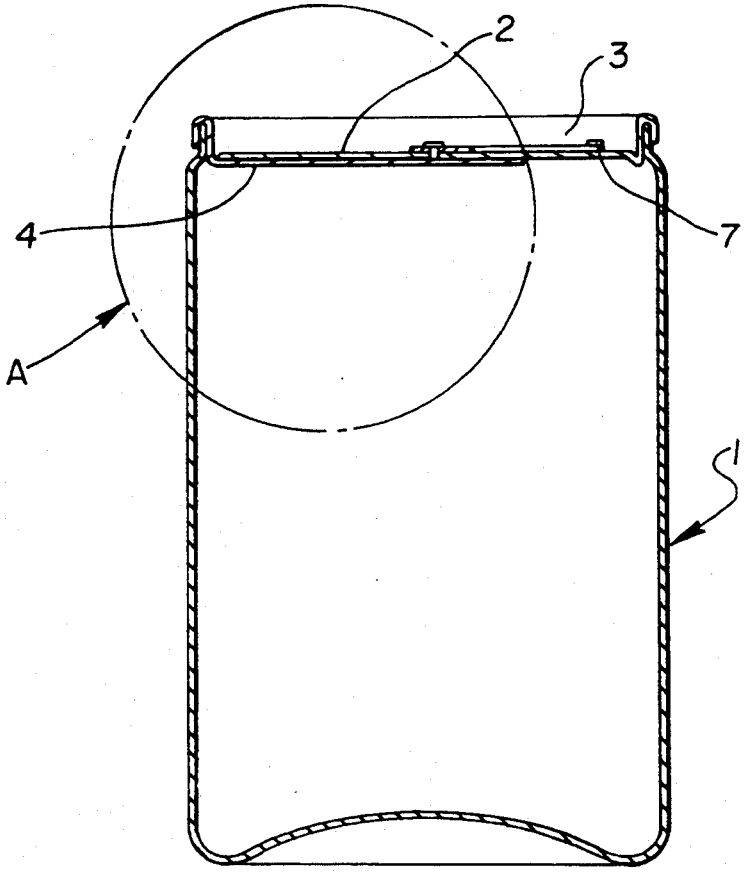
FIG. 3 is a longitudinal sectional view of the can of FIG. 1.
Figure 4:
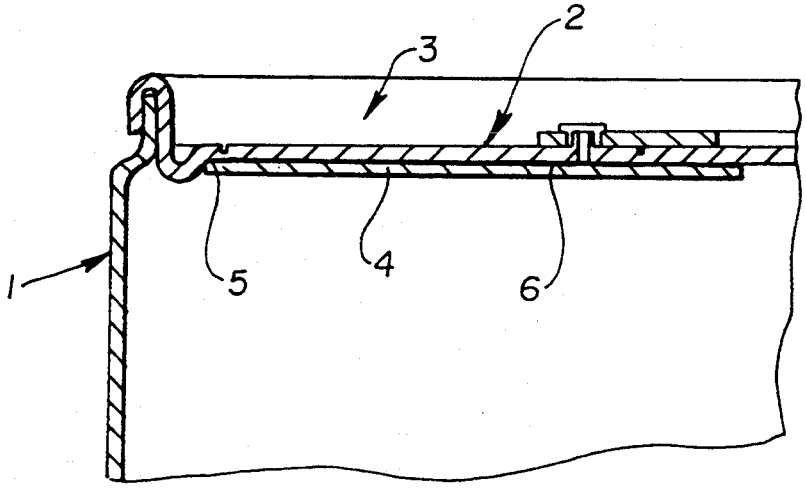
FIG. 4 is an enlarged sectional view of the circled part A of FIG. 3.

Referring first to FIGS. 1 to 8, there is shown a can in accordance with a primary embodiment of the present invention. In the conventional manner, the can comprises a can body 1 covered with a lid 3 having an opening part 2. Here, the lid 3 is seamed to the can body 1 such that the can body 1 is sealed up. In the can of the present invention, a flexible beverage guider 4 such as made of a synthetic resin is fixed to a curved fixing part 5 of the lid 3 such that the guider 4 is fixed to a lower surface of the lid 3 at a position adjacent to a curved outside edge of the opening part 2.

Here, the fixing of the guider 4 to the fixing part 5 of the lid 3 is achieved such as by thermal bonding.

Figure 6:
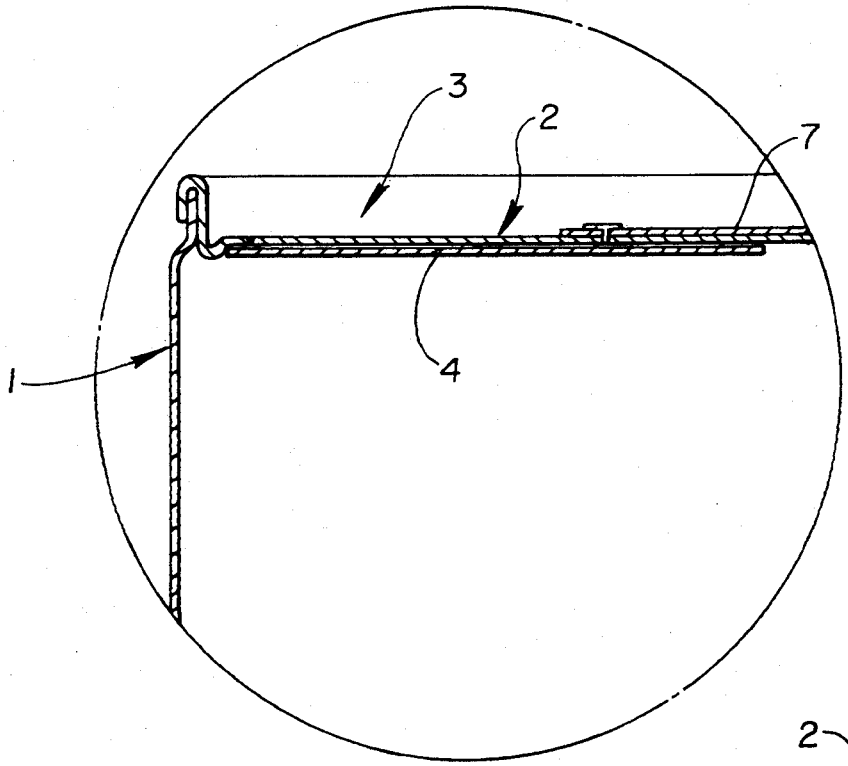
FIGS. 6 to 8 are enlarged sectional views of the can of FIG. 1 respectively, showing the opening operation of the can.
Figure 7B:
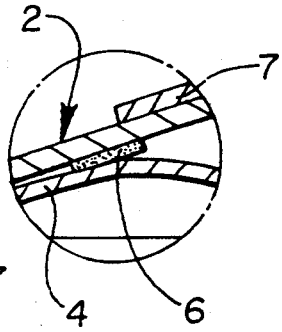
Figure 7A:
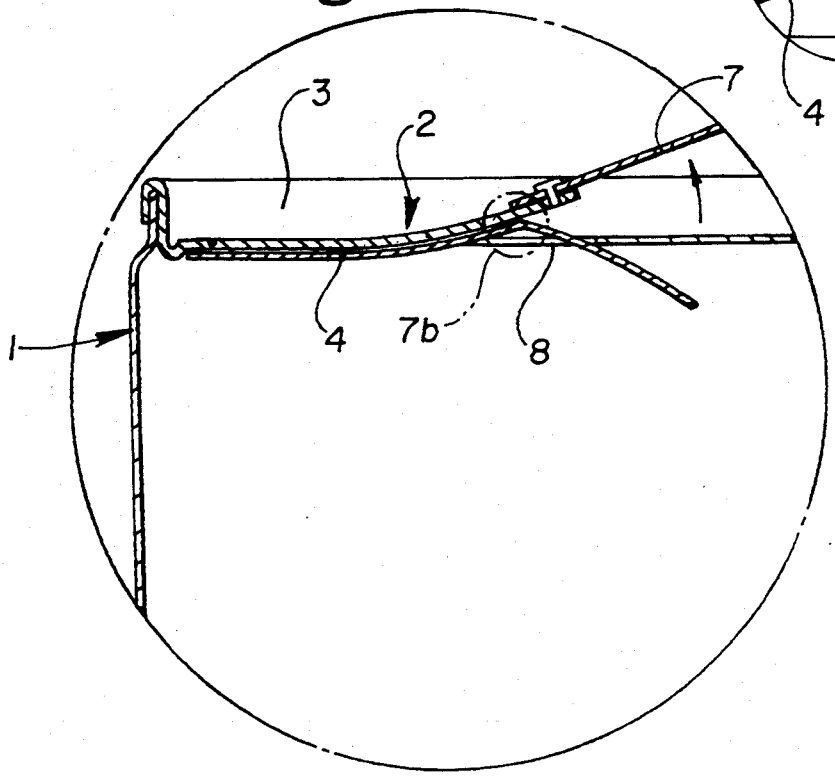
Figure 8:
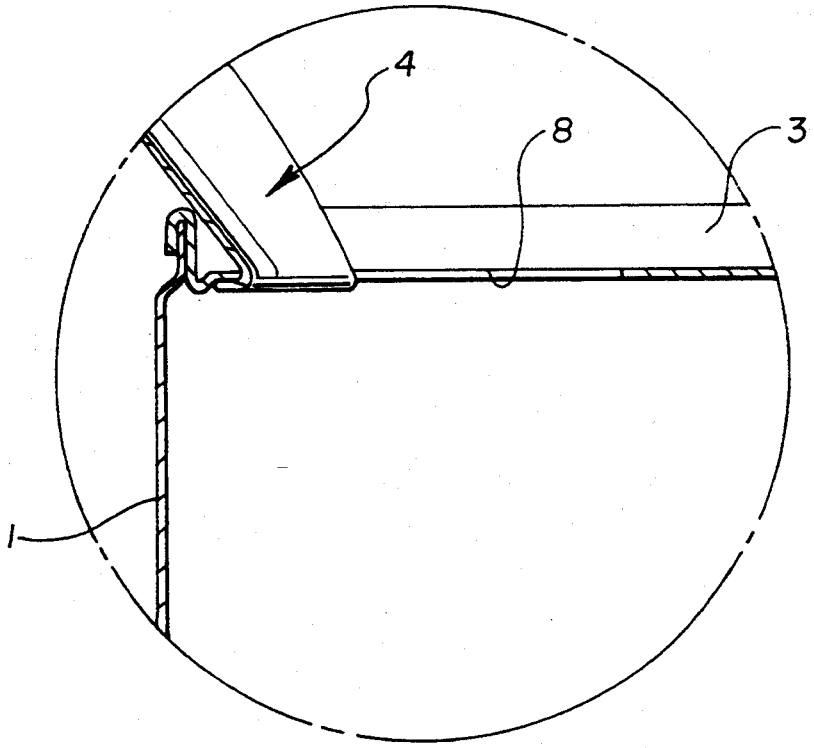

The guider 4 is provided with a bonding spot 6 at an inside section thereof. By the bonding spot 6, the guider 4 is bonded to the inside bottom surface of the opening part 2. As shown in FIG. 1, 6 and 8, when the opening part 2 is forcibly cut off and removed from the lid 3 of the can lid 3 by pulling a handle ring 7, the flexible guider 4 bonded to the bottom surface of the opening part 2 by the bonding spot 6 jumps out of the can lid 3 through an opening 8 and, thereafter, separated from the opening part 2 by the pulling force. Hence, the guider 4 jumping out of the can lid 3 is placed on its predetermined position as shown in FIG. 1.

Figure 5:
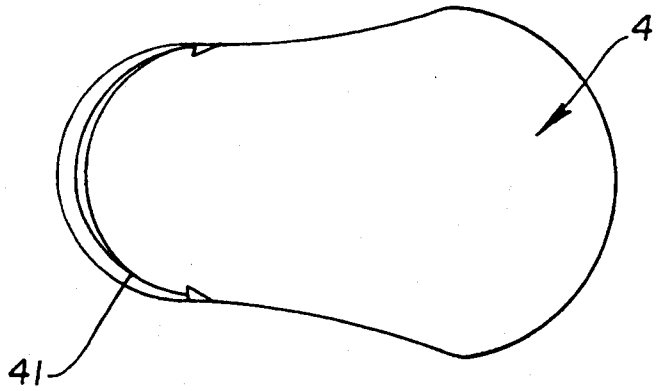
FIG. 5 is a plan view of a beverage guider of the can of FIG. 1.

FIG. 5 is a plan view of the guider 4 of the can. The guider 4 is provided with a curved groove 41 at a position adjacent to the fixing part 5. At the curved groove 41, the guider 4 is folded back when it completely jumps out of the can lid 3 through the opening 8 defined by the opening part 2 removed from the can lid 3. Thanking for the curved groove 41 of the guider 4, this guider 4 is easily folded back and reliably placed at its position shown in FIG. 1.

Figure 9:
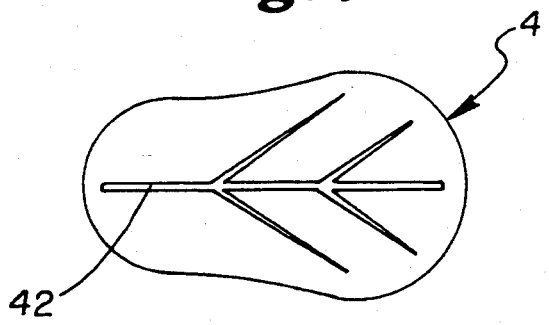
FIG. 9 is a bottom plan view of a beverage guider of a can in accordance with a second embodiment of the present invention.

FIG. 9 shows a guider 4 in accordance with a second embodiment of the present invention. This guider 4 is provided with a veined reinforcing rib 42 which maintains a desired bending shape of the guider 4 when the guider 4 is drawn out of the can lid 3 through the opening 8.

Figure 10:
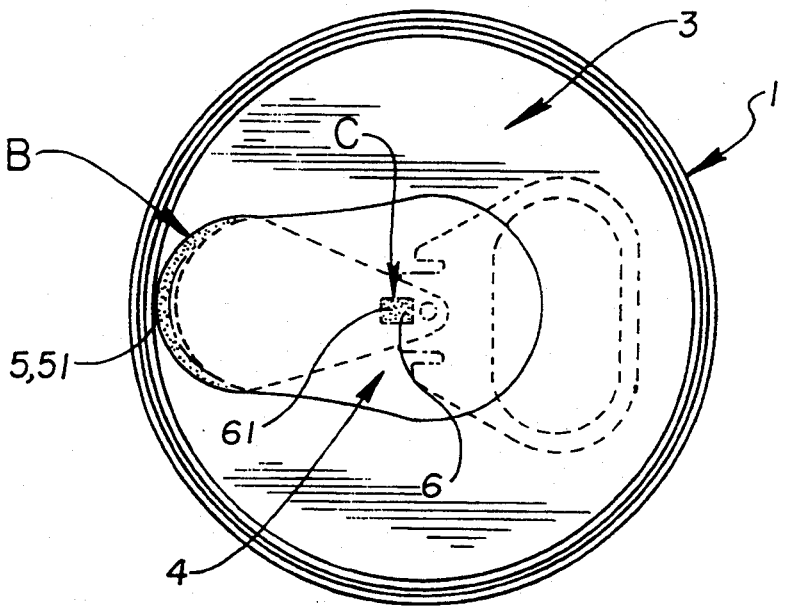
FIG. 10 is a cross sectional view of a can in accordance with a third embodiment of the present invention.
Figure 11:
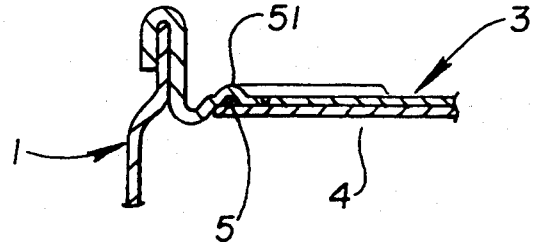
FIG. 11 is an enlarged sectional view of the section B of FIG. 10.
Figure 12:
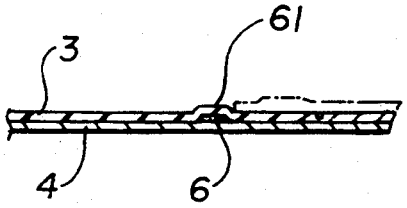
FIG. 12 is an enlarged sectional view of the section C of FIG. 10.

Turning to FIGS. 10 to 12, there is shown a can in accordance with a third embodiment of the present invention. In the can of the third embodiment, the can lid 3 is provided with a curved rib 51 on the fixing part 5 such that the curved rib 51 protrudes from the outer surface of the can lid 3. This curved rib 51 improves the bonding force between the guider 4 and the fixing part 5 and applies the can lid 3 with a desired reinforcing force. In addition, the opening part 2 of the can lid 3 is provided with a recess 61 at a position corresponding to the bonding spot 6, thus to increase the bonding force between the guider 4 and the opening part 2.

Figure 13:
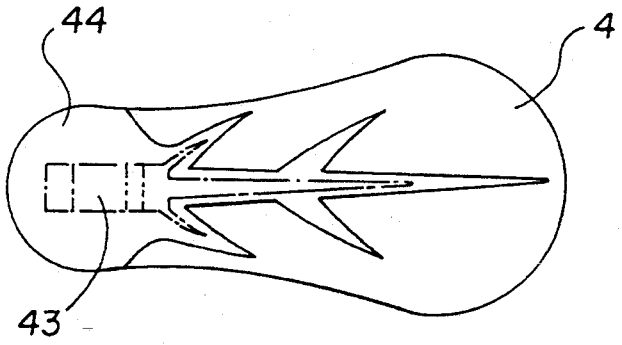
FIG. 13 is a bottom plan view of a beverage guider of the can in accordance with a fourth embodiment of the present invention.
Figure 14:
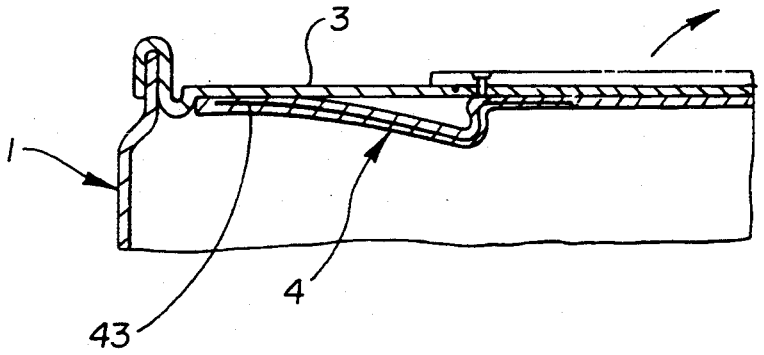
FIG. 14 is an enlarged sectional view of the can provided with the guider of FIG. 13.
Figure 15:
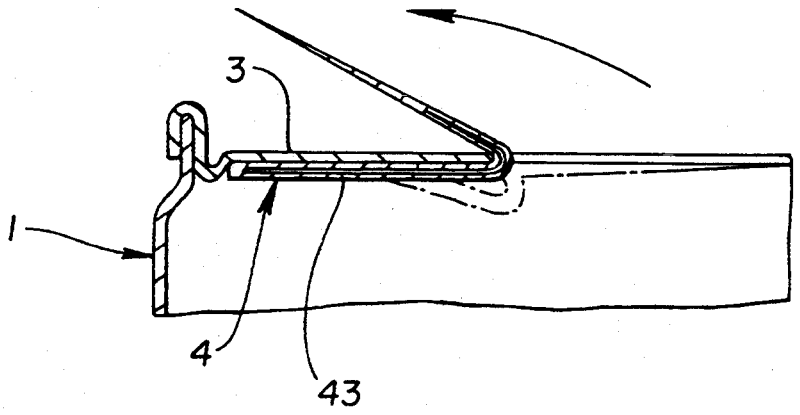
FIG. 15 is an enlarged sectional view of the can provided with the guider of FIG. 13, showing an operation of the guider.

Referring next to FIGS. 13 to 15, there is shown a guider 4 in accordance with a fourth embodiment of the present invention. This guider 4 is provided with an elastic thin plate 43 of the plate spring type which is inserted in the guider 4. The guider 4 of this fourth embodiment is integrated with the elastic thin plate 43 and bent at its middle section and bonded to the bottom surface of the can lid 3.

In this case, the elastic thin plate 43 may be inserted in a veined reinforcing rib 44 of the guider 4 as shown in FIG. 13. When the guider 4 according to the fourth embodiment is provided in the can lid 3, it is mounted on the bottom surface of the can lid 3 with an elasticity as shown in FIG. 14. When the opening part 2 is drawn in order to open the can lid 3, the guider 4 is elastically placed on its position out of the can lid 3 by the elasticity of the elastic thin plate 43 as shown in FIG. 15.

Figure 16:
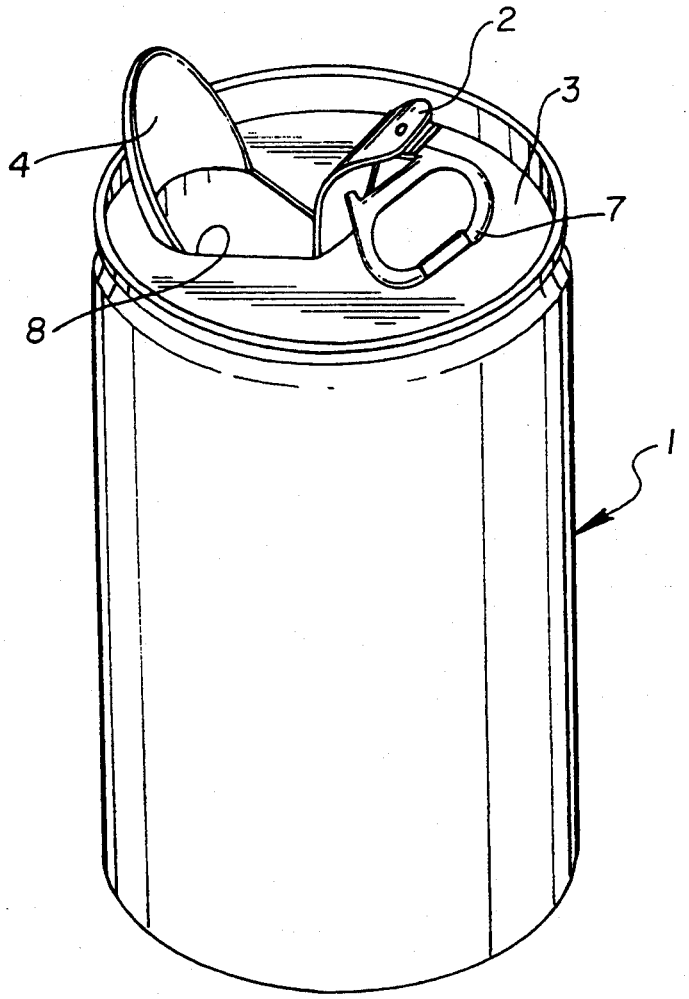
FIG. 16 is a perspective view of a can in accordance with a fifth embodiment of the present invention, showing an opening operation of the can.
Figure 17:
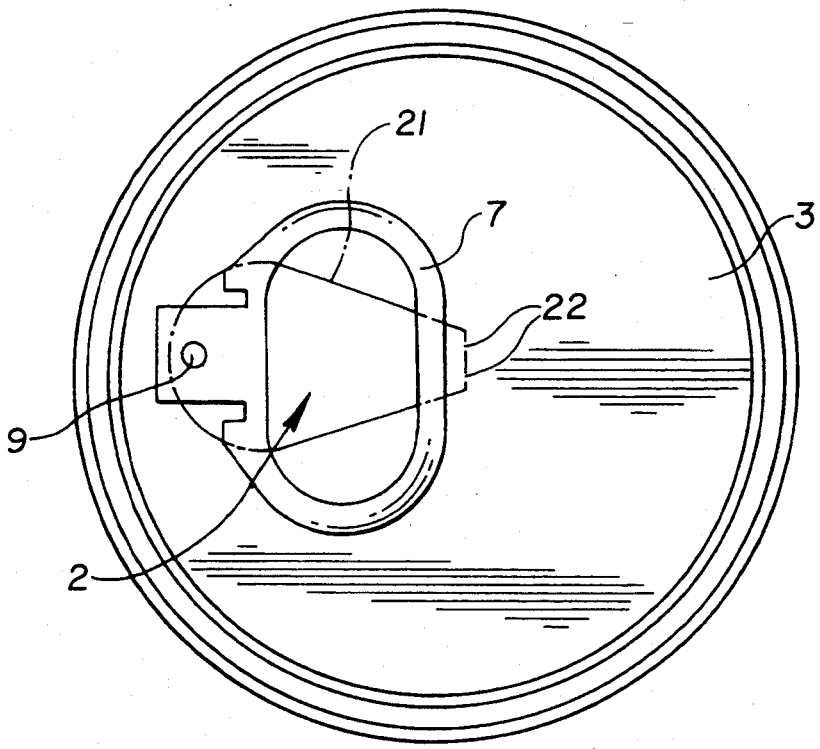
FIG. 17 is a plan view of the can of FIG. 16.

Turning to FIGS. 16 and 17, there is shown a can in accordance with a fifth embodiment of the present invention. In this fifth embodiment, the opening part 2 formed on the can lid 3 is defined by a rounded cutting line 21 at which the opening part 2 is cut off from the can lid 3 and defines the opening 8 through which the beverages are discharged from the can. However, this cutting line 21 is not a closed line differently from the above embodiments or the first to fourth embodiments but remains a connection part 22 at the inside ends thereof. Furthermore, the rivet 9 for connecting the handle ring 7 to the opening part 2 is provided on the outside section of the opening part 2 other than the inside section.

Of course, the can according to the fifth embodiment may be provided with the aforementioned beverage guider 4 as shown in FIG. 16. When the handle ring 7 is drawn in order to open the can lid 3, the opening part 2 is cut off along the cutting line 21 and provides the opening 8. In this case, the opening part 2 is not completely removed from the can lid 3 thanking for the connection part 22 but retained at the bent state as shown in FIG. 16.

As described above, the can according to the present invention is provided with a beverage guider 4 which is normally placed under the can lid and hidden in the can but drawn out of the can lid through an opening and placed at a predetermined position when the opening part of the can lid is drawn in order to open the can lid. In this regard, the can of this invention allows the canned beverages to be discharged from the can through the guider and to be served to the user, so that it prevents the contaminants of the can lid from introduction into the human body along with the beverages during drinking of the beverages. In addition, since the opening part of the can lid according to the present invention is not completely removed from the can lid but still connected to the can lid when the opening part is drawn in order to provide the opening on the can lid, thus to prevent an environmental contamination and a wound caused by the removed sharp opening part.

Furthermore, since the can of this invention is provided with the beverage guider of the simple construction, it is suitable for mass production and remarkably reduces the manufacturing cost particularly when comparing this can with the conventional cans provided with their respective straws. Another advantage of this can is resided in that it is used for containing alcoholic beverages which are not customarily drunk through a straw.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A can including a can body and a can lid, the can body being sealed by the can lid, the can lid having an opening part for opening the can, the can further comprising:

a mounting part provided on a lower surface of the can lid at a position adjacent an outside edge of the opening part;

a flexible beverage guider mounted on the mounting part, the. guider being normally hidden under the can lid but exposed to the outside of the can lid when the opening part is drawn in order to open the can, said beverage guider further including a curved groove at a position adjacent to said mounting part of the can lid, said guider being folded back at said curved groove when said guider is drawn out of said can lid.

2. The can according to claim 1, wherein the can includes an elastic thin plate of the plate spring type, the elastic thin plate being inserted in said guider, said guider having said elastic thin plate being bent at its middle section.

3. The can according to claim 2, wherein the beverage guider further includes a reinforcing rib, the reinforcing rib being provided on a lower surface of the guider, and wherein said elastic thin plate is inserted in said reinforcing rib of the guider.

4. The can according to claim 1, wherein said beverage guider further includes a bonding spot at an inside section thereof, said bonding spot bonding said inside section of the guider to an inside bottom surface of said opening part, thus to draw said guider out of said can lid when said opening part is drawn in order to open said can.

5. The can according to claim 4, wherein said beverage guider further includes a reinforcing rib, the reinforcing rib being located on a lower surface thereof, said reinforcing rib maintaining a desired bending shape of said guider when the guider is drawn out of said can lid.

6. The can according to claim 5, wherein the can includes a curved rib, the curved rib being provided on an outer surface of said can lid at a position corresponding to said mounting part.

7. The can according to claim 6, wherein a recess is provided on said opening part at a position corresponding to said bonding spot in order to increase a bonding force between said guider and said opening part.

* * * * *